US007820034B2

(12) United States Patent
Bruha

(10) Patent No.: US 7,820,034 B2
(45) Date of Patent: Oct. 26, 2010

(54) DILUENT FROM HEAVY OIL UPGRADING

(75) Inventor: Gerard Bruha, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 224 days.

(21) Appl. No.: 11/544,992

(22) Filed: Oct. 9, 2006

(65) Prior Publication Data

US 2008/0083653 A1 Apr. 10, 2008

(51) Int. Cl.
*C10G 9/00* (2006.01)

(52) U.S. Cl. ..... 208/106; 208/113; 208/120; 208/127; 208/164; 208/177; 208/251 R; 208/253; 208/435; 252/373

(58) Field of Classification Search ..... 208/106, 208/113, 120, 127, 164, 177, 251 R, 253, 208/435; 252/373
See application file for complete search history.

(56) References Cited

U.S. PATENT DOCUMENTS

| | | | | | |
|---|---|---|---|---|---|
| 2,879,224 | A | * | 3/1959 | Lawson | 208/100 |
| 3,647,682 | A | | 3/1972 | Rabo et al. | |
| 3,758,403 | A | | 9/1973 | Rosinski et al. | |
| 3,785,782 | A | | 1/1974 | Cartmell | |
| 4,354,923 | A | * | 10/1982 | Myers et al. | 208/113 |
| 4,404,095 | A | | 9/1983 | Haddad et al. | |
| 4,419,221 | A | | 12/1983 | Castagnos, Jr. et al. | |
| 4,536,283 | A | * | 8/1985 | Davis | 208/309 |
| 4,804,459 | A | * | 2/1989 | Bartholic et al. | 208/253 |
| 4,814,067 | A | | 3/1989 | Gartside et al. | |
| 4,828,679 | A | | 5/1989 | Cormier, Jr. et al. | |
| 4,875,998 | A | | 10/1989 | Rendall | |
| RE33,728 | E | | 10/1991 | Dean et al. | |
| 5,958,365 | A | * | 9/1999 | Liu | 423/655 |
| 6,357,526 | B1 | | 3/2002 | Abdel-Halim et al. | |
| 2003/0085385 | A1 | * | 5/2003 | Stellaccio et al. | 252/373 |
| 2004/0007500 | A1 | * | 1/2004 | Kresnyak | 208/187 |
| 2006/0042999 | A1 | | 3/2006 | Iqbal et al. | |

* cited by examiner

*Primary Examiner*—Prem C Singh
(74) *Attorney, Agent, or Firm*—KBR Legal Dept

(57) ABSTRACT

An apparatus and process for partially upgraded heavy oil diluent production. A crude heavy oil and/or bitumen feed is supplied to an FCC unit having a low activity catalyst and low conversion number. A distillate fraction is supplied for use as diluent to end users. The distillate fraction and FCC unit gas oil products can be supplied to a hydrotreater for upgrading and collected as a synthetic crude product stream. An asphaltene fraction can be supplied to a gasifier for the recovery of power, steam and hydrogen, which can be supplied to the hydrotreater or otherwise within the process or exported.

21 Claims, 3 Drawing Sheets

DILUENT FROM HEAVY OIL UPGRADING

CROSS REFERENCE TO RELATED APPLICATIONS

1. Field

The embodiments relate generally relates to fluidized catalytic cracking (FCC) in association with the processing of heavy oils and bitumens.

2. Background

As crude oil supplies decrease, the world has become increasingly dependent on heavy oil. In the pipelining of heavy oil, synthetic crude and other products obtained from heavy oil, a key factor for more efficient transportation is a low viscosity of the transported fluid. Low viscosity can be achieved by mixing a diluent with the heavy oil at the supply point. The diluent can be recovered at the delivery point and either recycled to the supply point or used for other purposes at the delivery point.

The transport of heavy oil has thus increased the demand for diluent. Past methods of diluent production from heavy oil rely on fractionating lighter distillates from portions of the heavy oil, which can then be mixed with the synthetic crude for transport. By its nature, fractionation imposes a physical limit to the quantity of distillates that can be produced and used as diluent. The prior art therefore limits the flexibility to meet pipeline specifications and/or quantities and requires transportation of diluent from locations remote to heavy oil upgrading facilities.

A need exists in the heavy oil upgrading environment for a process to locally produce sufficient diluent to meet demand.

BRIEF DESCRIPTION OF THE DRAWINGS

The detailed description will be better understood in conjunction with the accompanying drawings as follows.

Figure 1:
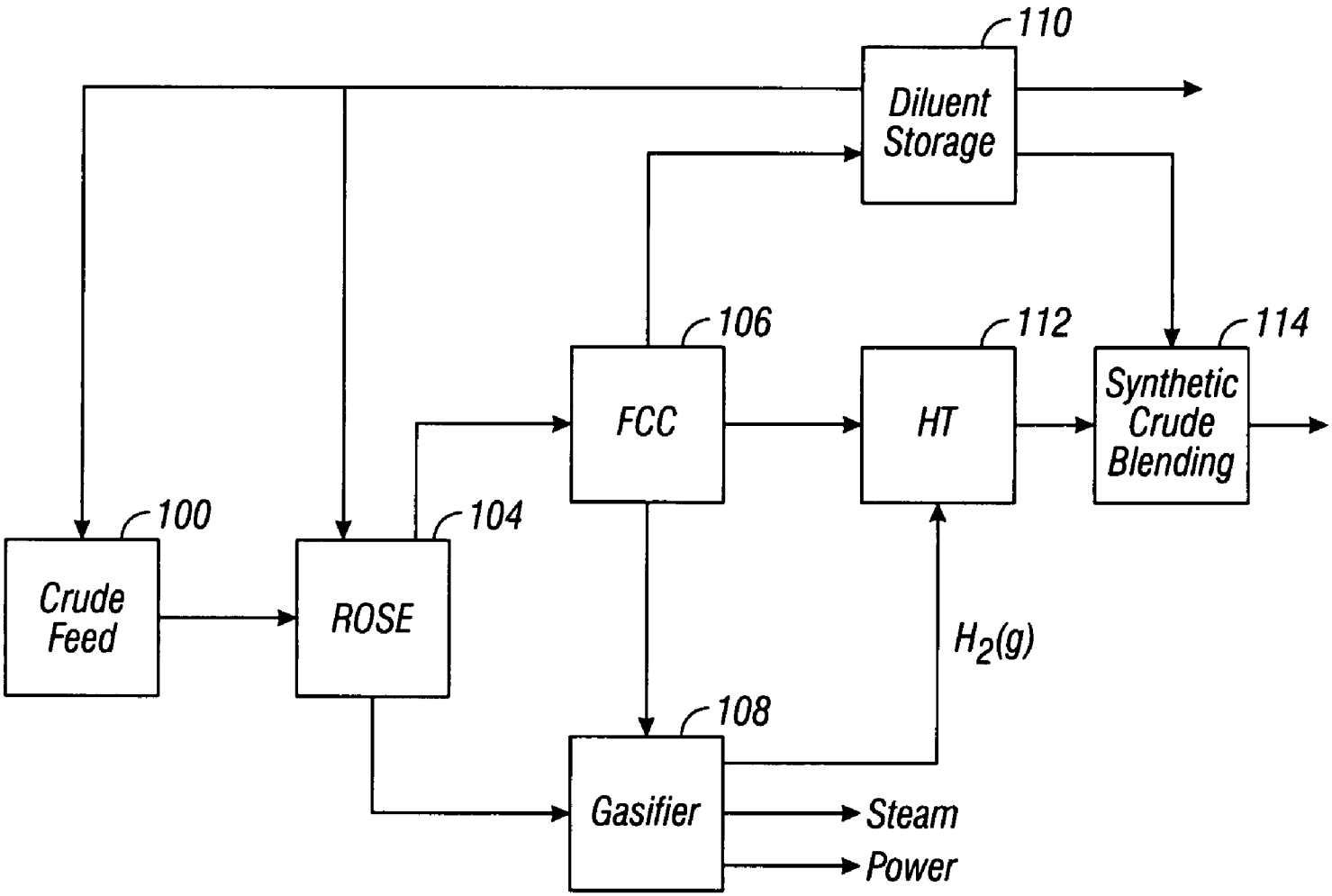
FIG. 1 depicts an embodiment of a process for the production of diluent.

The embodiments are detailed below with reference to the listed Figures.

DETAILED DESCRIPTION OF THE EMBODIMENTS

Before explaining the embodiments in detail, it is to be understood that the embodiments are not limited to the particular embodiments and that they can be practiced or carried out in various ways.

As a reference throughout the disclosure, the following terms can be defined, but not limited, as follows: "Conversion" or "conversion number" can be defined as the value 100 less the percent by weight cycle oil less the percent by weight bottoms, wherein cycle oil is light cycle oil (LCO) plus any heavy cycle oil (HCO). The conversion number can also be based on the total weight of the distillates (LPG, naphtha, diesel, gas oil, etc.), cycle oil and bottoms from a fractionation of the total FCC effluent.

"Catalyst activity" can be determined on a weight percent basis of conversion of a standard feedstock at standard FCC conditions by the catalyst microactivity test or MAT in accordance with ASTM D3907-03 or its equivalent.

"Steam Assisted Gravity Drainage" (SAGD) can be defined as a technique wherein steam and/or hot water are injected directly into a formation for enhanced recovery of oils. Steam and/or hot water are injected through one or more wells into the top of a formation and water and hydrocarbons can be recovered from one or more wells positioned at the bottom of the formation. SAGD can be inclusive of hot water and/or condensate as the motive fluid even though reference may be made specifically only to steam for the purposes of clarity and illustration.

An embodiment provides an apparatus and/or process for partially upgrading heavy oil with excess diluent production for heavy oil or synthetic crude transportation. A crude heavy oil and/or bitumen feed or fraction thereof can be supplied to an FCC unit with a low conversion activity catalyst, and a distillate fraction can be produced for use as diluent. The diluent can be used to transport heavy oil or bitumen, or products thereof, including synthetic crude oil for example.

In one embodiment, a process of naphtha production with a fluid catalytic cracking (FCC) unit is provided. The process can include supplying a feed including heavy oil or bitumen or a fraction thereof to a reaction zone of the FCC unit with catalyst at a catalyst-to-oil weight ratio ranging from about 4 to about 10; and operating the reaction zone at a conversion number ranging from about 40 to about 60 to obtain a hydrocarbon effluent. The total hydrocarbon effluent can include naphtha in excess of 50 percent by weight, based on the weight of the total hydrocarbon effluent from the reaction zone, i.e. a naphtha selectivity of 50 percent or more by weight. In an embodiment, the MAT catalyst activity can be from about 35 to about 75. In an alternative embodiment, the MAT catalyst activity can be less than about 65.

An embodiment can include a process for transporting heavy oil. The process can include recovering naphtha from the effluent; mixing the recovered naphtha as a diluent with a heavy oil stream to be transported; and transporting the resulting mixture of the diluent and the heavy oil stream. In an embodiment, the recovered naphtha diluent can include a cut point range (distillation range), from the boiling point of pentane (C5) to 290° C. and an API gravity of at least 30. An alternative embodiment can include transporting the mixture of heavy oil and diluent to the FCC unit, with or without additional processing, or to another refinery or destination at a nearby or remote location.

An embodiment of the process can include: operating the FCC unit to produce decant oil, gas oil and distillate streams; supplying the decant oil stream to a gasifier to produce power, steam and hydrogen; hydrotreating the gas oil stream with the hydrogen to produce a hydrotreated product; and blending the distillates with the hydrotreated product to produce synthetic crude.

The FCC feed can include deasphalted oil (DAO) from a solvent deasphalting process, and the solvent deasphalting process can receive a crude feed supply. Alternatively, the FCC feed can include DAO from a solvent deasphalting process, and the solvent deasphalting process can in turn receive a feed supplied as the heavy oil or bitumen recovered from a diluent recovery unit (DRU) processing a mixture of heavy oil or bitumen and diluent. The DRU can receive a diluent and heavy oil or bitumen feed mixture supplied by diluent-assisted transport of heavy oil from a steam assisted gravity drainage unit (SAGD), a mining and extraction unit, or the like or a combination thereof.

The solvent deasphalting process can include producing an asphaltenes-rich stream and can further include converting the asphaltenes to steam, power, fuel gas, and the like or a combination thereof. An embodiment of the process can include producing the heavy oil or bitumen by extraction from mined tar sands.

The power, steam and/or fuel gas can be generated by the combustion and/or gasification of asphaltenes recovered from the asphaltenes fraction from the solvent deasphalting can be used for operation of equipment used in the mining and extraction of the tar sands.

An alternative embodiment can include producing the heavy oil or bitumen by injecting a mobilizing fluid through one or more injection wells completed in communication with a reservoir to mobilize the heavy oil or bitumen and producing the mobilized heavy oil or bitumen from at least one production wells completed in communication with the reservoir. In an embodiment, the mobilizing fluid can include steam generated primarily by combustion of asphaltenes from solvent deasphalting the heavy oil or bitumen. An embodiment can include feeding a portion of the asphaltenes fraction to a delayed coker unit to produce coker liquids and coke.

In an alternative embodiment, a process of naphtha production with a fluid catalytic cracking (FCC) unit is provided. The process includes: supplying a feed including at least a fraction of deasphalted oil from a solvent deasphalting process to a reaction zone of an FCC unit with catalyst at a catalyst-to-oil weight ratio of from 4 to 10; wherein the solvent deasphalting process receives heavy oil or bitumen supplied from a diluent recovery unit (DRU) receiving a mixture of diluent and heavy oil or bitumen from a steam assisted gravity drainage (SAGD) unit, a mining and extraction unit, and the like or a combination thereof; wherein the solvent deasphalting process produces an asphaltenes-rich stream and further including feeding at least a portion of the asphaltenes to a delayed coker unit to produce coker liquids and coke and converting at least a portion of the asphaltenes to steam, power, fuel gas, or a combination thereof; operating the reaction zone at a conversion number of from 40 to 60 to obtain a hydrocarbon effluent at a naphtha selectivity in excess of 50 percent, based on the weight of the total hydrocarbon effluent from the reaction zone; operating the FCC unit to produce decant oil, gas oil and distillate streams; recovering naphtha from the hydrocarbon effluent; mixing the recovered naphtha as a diluent with a heavy oil stream to be transported; transporting the mixture of heavy oil and diluent to the FCC unit; wherein the recovered naphtha diluent has a cut point range from C5 to 290° C. and an API gravity of at least 30; supplying the decant oil stream to a gasifier to produce power, steam and hydrogen; hydrotreating the gas oil stream with the hydrogen to produce a hydrotreated product; and blending the distillates with the hydrotreated product to produce synthetic crude.

One embodiment provides an apparatus for producing a pipelineable naphtha-heavy oil mixture with a fluid catalytic cracking (FCC) unit. An embodiment includes: a feed line to a reaction zone of the FCC for heavy oil or bitumen or a fraction thereof; a catalyst line to the reaction zone from a source of catalyst; a catalyst and feed proportional rate controller to operate the reaction zone with a catalyst-to-oil weight ratio of from 4 to 10; a line to recover a total hydrocarbon effluent including naphtha from the FCC unit; a fractionator to recover a naphtha-rich stream from the total hydrocarbon effluent; a line for transporting the naphtha-rich stream to a heavy oil pipeline terminal; a mixer for diluting a heavy oil stream with the naphtha-rich stream; and a pump for transporting the diluted heavy oil stream through a pipeline.

Embodiments can convert heavy oils and/or bitumen to lower boiling hydrocarbons with a proportion of naphtha or other hydrocarbons for use internally to supply diluent for heavy oil transportation or other uses at other locations. Embodiments can provide for the simultaneous production of asphaltenes for use as fuel in the generation of steam and energy for the production of the heavy oil or bitumen. An embodiment can process heavy oil or bitumen with a relatively high proportion of metals. A first portion of the metals can be removed during solvent extraction of the heavy oil or bitumen feed, with substantially all remaining metals being removed during subsequent treatment in an FCC unit. The embodiments can provide a substantial economic advantage by eliminating the need to transport diluent from distant sources to heavy oil upgrading facilities, and in an embodiment can also eliminate the need to transport natural gas or other fuel to the location of the reservoir or mine for steam and or power generation. The heavy oil can be upgraded by front-end removal of the asphaltene fraction, which can frequently contain a substantial portion of sulfur, nitrogen and metal compounds. The deasphalted oil can be liquid at ambient condition and can be transported.

Throughout the embodiments, the MAT catalyst activity can be from about 35 to about 75 (An example MAT catalyst activity is less than about 65).

With reference to the figures, FIG. 1 depicts an embodiment of a process for the production of diluent. A crude feed 100, which can include heavy oils and/or bitumens, can be supplied optionally first to a residuum oil solvent extraction (ROSE) unit 104 and then to a fluid catalytic cracking (FCC) unit 106. The feed can optionally include a hydrocarbon solvent or diluent to assist in reducing the viscosity of the feed. The ROSE unit 104 separates the feed into at least two fractions: a first fraction which can include deasphalted oils and resins, and a second fraction which can include asphaltenes. A portion of the metals present in the initial feed can be separated from the distillate feed and can remain with the separated asphaltenes. The deasphalted oils and resins can be supplied to the FCC unit 106, which can include a low activity catalyst, to upgrade the oils and effectively remove remaining metals.

The asphaltenes from the ROSE unit 104 can be converted to pelletized form or can alternatively be supplied to a gasifier 108, which burns and/or partially oxidizes the asphaltenes to produce steam, hydrogen and low energy gas. An effluent from the FCC unit 106 includes naphtha that can be accumulated in a diluent storage facility 110 for use in the heavy oil upgrading process and transportation or exported to other users. For example, the diluent can be used to transport crude feed 100 and/or as a solvent in the ROSE unit 104. The diluent can include a range of properties for the particular use, for example, a boiling range cut from C5 to 149° C., 221° C., 288° C. or the like, and an API gravity of at least 30, 40, 50, 60, 65 or the like (as exampled in Table 1)

TABLE 1

Estimated Diluent Properties

| Cut Point Range, ° C. | API | SG | Distillation fraction, wt % IBP | 10 | 30 | 50 | 70 | 90 | EP |
|---|---|---|---|---|---|---|---|---|---|
| | | | Boiling Point, ° C. | | | | | | |
| C5 to 149 | 65 | 0.7201 | 20 | 32 | 57 | 83 | 109 | 136 | 149 |
| C5 to 221 | 51 | 0.7753 | 20 | 39 | 82 | 127 | 168 | 205 | 221 |
| C5 to 288 | 34 | 0.8550 | 20 | 52 | 122 | 187 | 237 | 272 | 288 |

Continuing with FIG. 1, another effluent from the FCC unit 106 can be supplied to a hydrotreater unit 112 where the effluent can be upgraded, desulfurized and separated to produce low-sulfur naphtha, distillate and gas oil streams. The decant oil from the FCC 106 can be supplied to the gasifier 108. The steam, hydrogen and low energy fuel gas produced by the gasifier 108 can be supplied to associated processes as needed. The product streams from the hydrotreater 112 can be combined in a synthetic crude blending facility 114, optionally with diluent from the storage facility 110, to form a synthetic crude if desired.

Heavy oils and bitumens can be recovered through thermal processes in which heat is generated above ground or in situ. An example of a thermal process is steam injection, wherein steam is used as a driving fluid to displace oil. Steam Assisted Gravity Drainage (SAGD) is a technique wherein steam is injected directly into a formation for enhanced recovery of oils. Steam can be injected through one or more wells into the top of a formation and water and hydrocarbons can be recovered from one or more wells positioned at the bottom of the formation. SAGD processes generally include a high recovery rate and a high oil rate at economic oil-to-steam ratios. Production using SAGD processes can be improved, if desired, by using techniques such as for example, injecting steam into some of the wells at a higher rate than others, applying electrical heating to the reservoir, and employing solvent CO2 as an additive to the injection steam. An example of an SAGD can be found in Abdel-Halim U.S. Pat. No. 6,357,526.

Heavy crudes can be recovered by a variety of mining techniques, including employing shovels, trucks, conveyors and the like, to recover substantially solid bitumens and tar sands. The shovels can be electrically or hydraulically powered. Tar sand deposits can be excavated using techniques for the recovery of heavy oils contained therein. The excavated sand deposits can optionally be pre-conditioned to facilitate the extraction and separation of bitumen oils. The tar-sands can be crushed to a smaller size using crushers, and can be further broken down using mechanical crushing and/or agitation. The crushed tar-sands can be readily slurried with hot water for transportation and supplied to a bitumen extraction and separation process. An example of conditioning of tar-sands can be found in Rendall U.S. Pat. No. 4,875,998.

The conditioned heavy oil or bitumen, mixed with steam and/or water can be passed through a water-oil separator to separate the fluids and produce a heavy oil or bitumen stream essentially free of water and solids. The heavy oil or bitumen can be separated in a continuous fractionation process, normally taking place at atmospheric pressure and a controlled bottom temperature of less than 400° C. (750° F.). The temperature of the fractionation tower bottoms can be controlled to prevent thermal cracking of the crude feed, and vacuum fractionation can be used.

The heavy oil or bitumen, or the resid from atmospheric and/or vacuum distillation, can be supplied to a solvent deasphalting unit employing equipment and methodologies for solvent deasphalting, for example, under the trade designations ROSE, SOLVAHL, or the like. The solvent deasphalting unit can separate the heavy oil or bitumen into an asphaltene-rich fraction and a deasphalted oil (DAO) fraction. The deasphalting unit can be operated and conditions varied to adjust the properties and contents of the DAO and asphaltenes fractions. The deasphalting unit can be controlled to ensure high lift in which a majority of the resins present in the feed can be separated as deasphalted oils rather than asphaltenes. The asphaltene phase can be essentially free of resins. The asphaltene phase can be heated and steam stripped to form an asphaltene product stream. The solvent-DAO phase can be heated to separate the components into solvent and DAO phases. The DAO phase can be recovered, heated and steam stripped to form a DAO product stream for further treatment.

The ROSE unit 104 can be readily modified for use. Where no upstream crude fractionation is employed, such modifications can be made to accommodate the entire crude feed, and not just the resid fraction of the feed. Deasphalting can be accomplished by dissolving the crude feedstock in an aromatic solvent, followed by the addition of an excess of an aliphatic solvent to precipitate the asphaltenes. Subcritical extraction, where hydrocarbon solvents can be mixed with alcohols, can be used. Most deasphalting processes employ light aliphatic hydrocarbons, such as for example, propane, butane, and pentane, to precipitate the asphalt components from the feed. Naphtha from diluent storage 110 can be used as a source of deasphalting solvent.

Figure 3:
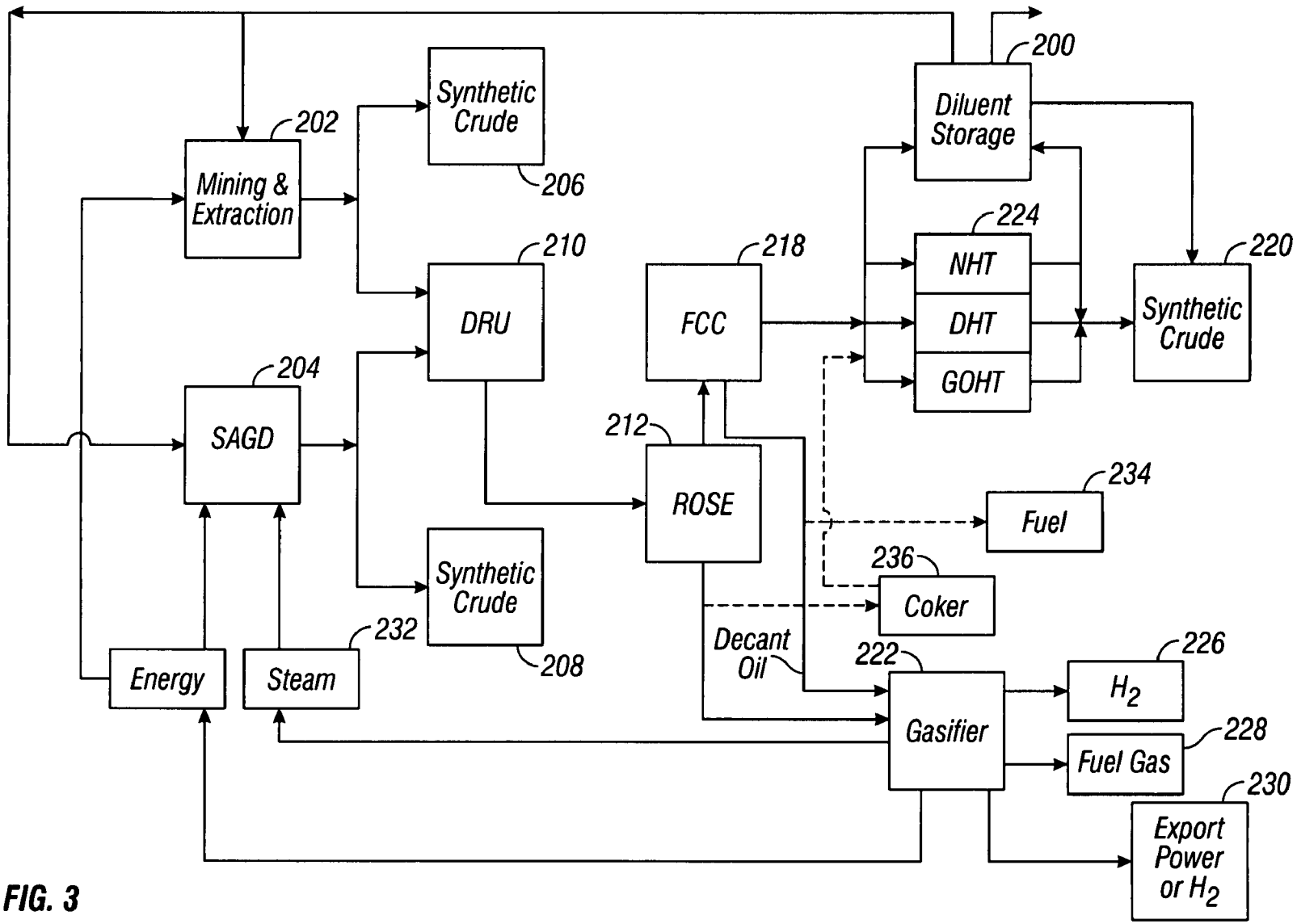
FIG. 3 depicts an embodiment of a diluent production process, wherein the process exampled in FIG. 1 includes gasification, hydrotreating and a coking unit.

The DAO fraction can be supplied to an FCC unit 106 containing a cracking catalyst. The FCC unit can include a stripper section and a riser reactor. Fresh catalysts can be added to the FCC unit, for example via the regenerator. Spent catalyst, including coke and metals deposited thereon, can be regenerated by complete or partial combustion in a regenerator to supply regenerated catalyst for use in the reactor. The flue gases can be withdrawn from the top of a regeneration reactor through a flue gas line. As illustrated in FIG. 3, a decant oil stream containing heavy oils and catalyst fines can be withdrawn from the FCC unit 218 and supplied as a fuel oil and/or to a gasifier 222 and/or coker 236. Examples of FCC processes can be found in Gartside U.S. Pat. No. 4,814,067; Haddad U.S. Pat. No. 4,404,095; Cartmell U.S. Pat. No. 3,785,782; Castagnos, Jr. U.S. Pat. No. 4,419,221; Cormier, Jr. U.S. Pat. No. 4,828,679; Rabo U.S. Pat. No. 3,647,682; Rosinski U.S. Pat. No. 3,758,403; and Dean U.S. Pat. No. RE 33,728.

The catalyst inventory employed in the FCC unit can have a catalyst activity (equilibrium catalyst microactivity test (MAT) conversion) from about 35, 40, 45 or 50 as a lower limit up to less than about 75, 65 or 60 as an upper limit, or a range from any lower limit to any upper limit. The mild reaction severity conditions can provide a relatively low conversion number, for example, from 30, 35, 40 or 45 volume percent as a lower limit, up to 65, 60, 55 or 50 volume percent as an upper limit, or a range from any lower limit to any upper limit. Higher catalyst activity and/or conversion numbers do not generally provide any benefit in the present invention and have the disadvantage of higher catalyst replacement rates. By maintaining lower catalyst activity, catalyst consumption can be optimized for more economic usage of the catalyst.

In catalytic cracking, catalyst particles are heated and introduced into a fluidized cracking zone with a hydrocarbon feed. The cracking zone temperature in one embodiment can be maintained from about 505° to about 550° C. (about 940° and 1020° F.) at a pressure from about 0.17 to about 0.38 MPa (25 and 55 psia). The circulation rate of the catalyst in the reactor can range from about 4 to about 10 kg/kg of hydrocarbon feed, depending on the metals content in the feed, a higher metals content generally requiring a higher catalyst-to-oil ratio. Catalysts that can be employed in the practice of embodiments include but are not limited to Y-type zeolites, USY, REY, RE-USY, faujasite and other synthetic and naturally occurring zeolites, and mixtures thereof. Other suitable cracking catalysts include, but are not limited to, those containing silica and/or alumina, including acidic catalysts. The catalyst can contain refractory metal oxides such as magnesia or zirconia. The catalyst can contain crystalline aluminosilicates, zeolites, or molecular sieves. Discarded or used catalyst from a high activity FCC process can be employed in the place of fresh catalyst.

The FCC unit can produce some lighter gases such as fuel gas, liquefied petroleum gas (LPG), or the like, which can be used as a fuel. These can contain sulfur compounds which can be removed using a small sulfur removal unit with amine absorption, or the like.

The asphaltene fraction from the ROSE unit can be pelletized. An example of a suitable pelletizer is described in U.S. Pat. No. 6,357,526 to Abel-Halim, et al. The asphaltene pellets can be transported in a dewatered form by truck, conveyor, and the like, to a boiler or gasifier, or can be slurried with water and transferred via pipeline. A portion of the asphaltenes can be passed or transported to a solids fuel mixing facility, such as a tank, bin or furnace, for storage or use as a solid fuel. The boiler can be a circulating fluid bed boiler, which burns the pellets to generate steam for use in the SAGD process for the production of the heavy oil or bitumen. Alternatively, the boiler can provide electric power, or steam for the excavation and extraction equipment in a tar sand mining operation, including shovels, trucks, conveyors, hot water and so forth. The quantity of asphaltenes produced can be large enough to satisfy all of the steam and power requirements in the production of the heavy oil or bitumen, thus eliminating the need for imported fuel or steam, resulting in a significant reduction in the cost of production.

A gasifier can alternatively or additionally be employed; with the asphaltene fraction being conveniently pelletized and slurried to supply the water for temperature moderation in the gasification reactor. Excess asphaltene pellets not required for the boiler(s) and/or gasification can be shipped to a remote location for combustion or other use. Steam can be generated by heat exchange with the gasification reaction products, and CO2 can be recovered for injection into the reservoir with steam for enhanced production of heavy oils and bitumen. Hydrogen gas, and/or a low value fuel gas, can be recovered from the gasification effluent and exported, or the hydrogen can be supplied to an associated hydrotreating unit, as described below. Power can be generated by expansion of the gasification reaction products and/or steam via a turbine generator. The power, steam and/or fuel gas can be used in the heavy oil or bitumen production, e.g. mining operations or SAGD, as described above. During startup, asphalt pellets, natural gas, or other fuel can be imported to fire the boiler to supply sufficient steam and/or energy for the production of heavy oil or bitumen until the recovered asphaltene fraction is sufficient for steam generation.

Alternatively or additionally, a portion of the asphaltene fraction and/or slurry oil can be supplied to a coker unit for distillates recovery. Coking processes can convert heavy low value residuum feeds from vacuum or atmospheric distillation columns to obtain coke and gas oil. The asphaltene fraction can be heated to high temperatures in a coker unit, e.g. 480-510° C. (900-950° F.) to generate lighter components which can be recovered as a vapor, and coke which forms as a solid residue in the coking unit. The coker unit can be a delayed coker, a flexicoker, a fluid coker, or the like. In a delayed coking process, the feed can be held at a temperature of about 450° C. and a pressure from about 75 to about 170 kPag (10 to 25 psig) to deposit solid coke while cracked vapors can be taken overhead. Coke produced in the coker can be transported to a storage area for use as a solid fuel.

Product vapors from the coker can be withdrawn from the coker and supplied to an associated process, including a hydrotreating process. Optionally, the coker vapors can be separated by distillation into naphtha, distillate and gas oil fractions prior to being supplied to the hydrotreatment unit, and the naphtha or a portion thereof can be produced as additional diluent, for example, to the diluent storage facility. By limiting the feed to the coker in the present process to the excess asphaltenes fraction and FCC slurry oil that is not needed for generating steam, hydrogen and power, the size of the coker can be advantageously reduced relative to front-end coker processing schemes.

Hydrotreatment of the naphtha, distillates, gas oil and any other portion of the FCC effluent (and any coker liquids) can improve the quality of the various products, including diluent in an embodiment, and/or crack residuum oils to lower-boiling, more valuable products. Mild hydrotreating can remove unwanted sulfur, nitrogen, oxygen, and metals, as well as hydrogenate any olefins. However, removal of sulfur and metals via a front-end hydrotreating process before FCC processing requires relatively large amounts of hydrogen, often requiring a separate hydrogen production unit or other source.

An optional hydrotreater can operate downstream from the FCC unit to treat the hydrocarbons after the metals have been removed, and can primarily serve to remove sulfur. The hydrotreater can operate at from about 0.8 to about 21 MPa (from about 100 to about 3000 psig) and from about 3500 to about 500° C. (from about 650° to about 930° F.). Mild operating conditions for the hydrotreater in an embodiment can include a fixed bed operating at from about 1.5 to about 2.2 MPa (from about 200 to about 300 psig) and from about 350° to about 400° C. (from about 650° to about 750° F.), without catalyst regeneration. Severe operating conditions for the hydrotreater in an embodiment can be from about 7 to about 21 MPa (from about 1000 to about 3000 psig) and from about 350° to about 500° C. (from about 650° to about 930° F.), and can require catalyst regeneration. The pressure can be maintained in a moderate range from about 3.5 to about 10.5 MPa (from about 500 to about 1500 psi) in an alternative embodiment. Hydrogen consumption increases with increased severity of operating conditions and depends upon the amount of metal and sulfur removed and the feed content of aromatic materials and olefins, which consume hydrogen. Because the metal content of the feed to the hydrotreater is negligible in this embodiment, a guard bed is not needed and high activity catalyst can be employed. Gas and LPG products from the hydrotreater can contain sulfur compounds, which can be removed in a sulfur recovery unit as described above. The sulfur recovery unit processing the hydrotreater light ends can be used for the FCC effluent, sized appropriately to accommodate both feeds, or separate sulfur recovery units can be employed.

By placing the solvent deasphalting and FCC units upstream of the hydrotreater, and removing metals prior to hydrotreating, the present invention can decrease the dependence of the process on the production of large quantities of hydrogen, and decreases the need for separate hydrogen production facilities.

Individual aspects of embodiments can be added to existing bitumen processing facilities, or facilities can be constructed incorporating any number of the aspects of the embodiments.

Figure 2:
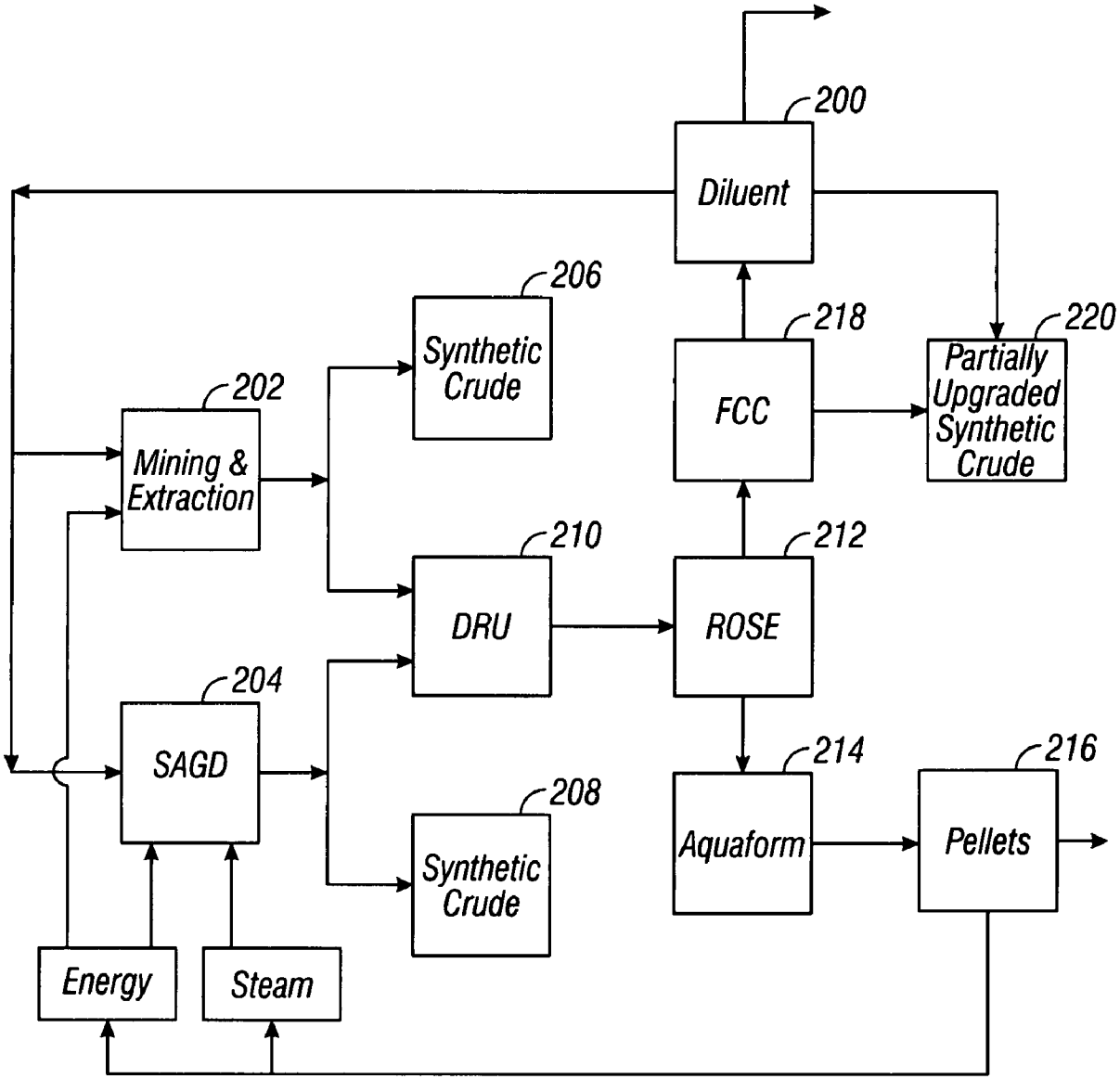
FIG. 2 depicts an embodiment of a diluent production process, wherein the process exampled in FIG. 1 includes an integrated mining and extraction, a steam assisted gravity drainage (SAGD), a diluent recovery unit (DRU), and an aquaform unit.

FIG. 2 depicts an embodiment of a diluent production process, wherein the process exampled in FIG. 1 includes an integrated mining and extraction, a steam assisted gravity drainage (SAGD), a diluent recovery unit (DRU), and an aquaform unit. Referring initially to FIG. 2, the base case upgrade in the implementation of localized production of diluent 200 is shown. A heavy oil and/or bitumen feed can be obtained by excavation 202 and/or steam assisted gravity drainage 204. Diluent 200 can be supplied to the mining operation 202 and SAGD 204 to mix with the heavy oil/bitumen and form a pipelineable synthetic crude 206 and 208, respectively. The diluent can be used to facilitate transfer of the heavy oil/bitumen feed from the same or different mining operation 202 and SAGD 204 to the diluent recovery unit (DRU) 210 wherein the crude undergoes atmospheric distillation.

The residue from the distillation column in DRU 210 can be supplied to an on-site or nearby ROSE unit 212 for separation of the DAO and resins from the asphaltenes. The asphaltene fraction can be removed from the ROSE unit 212 and supplied to an aquaform unit 214 for the preparation of asphaltene pellets 216. The asphaltene pellets 216 can be used as fuel, exported or stored. The DAO/resin fraction from the ROSE unit 212 can be fed to an FCC unit 218, which can be at the same location or in close proximity to the ROSE unit 212. The FCC unit 218 can include a low activity catalyst and be operated at a low conversion number as previously described herein. The FCC unit 218 removes substantially all remaining metals in the feed not previously removed by the ROSE unit 212, and produces excess diluent 200 for heavy oil/bitumen transport to the DRU 210 or to prepare synthetic crude 206, 208 as previously mentioned. Effluent from the FCC unit 218 such as distillates, gas oil, etc. can be optionally hydrotreated as described above and blended with diluent 200 to obtain a partially upgraded synthetic crude 220 that can be readily transported, e.g. via pipeline to a refinery.

FIG. 3 depicts an embodiment of a diluent production process, wherein the process exampled in FIG. 1 includes gasification, hydrotreating and a coking unit. Referring to FIG. 3, the process of FIG. 2 can be modified to include a gasifier 222, and a hydrotreater 224 downstream of the FCC unit 218. The asphaltene fraction from the ROSE unit 208 can be supplied to the gasifier 222 which partially oxidizes the asphaltene to produce hydrogen 226, fuel gas 228, power 230 or a combination thereof, which can either be exported or supplied to the SAGD unit 204, and steam 232, which can be supplied to the SAGD unit 204. A decant oil stream recovered from the FCC unit 218 can be supplied to the gasifier 222, or used as fuel 234. Effluent from the FCC unit 218 not produced as diluent 200 can be hydrotreated via the hydrotreater 224, which can optionally include separating the naphtha, distillate, and gas oil prior to hydrotreating. The naphtha fraction can be supplied to diluent 200 with or without hydrotreating in whole or in part, and the hydrotreated naphtha, distillate, gas oil or a combination thereof can be blended with diluent 200 to produce synthetic crude 220. The gasifier 222 and hydrotreater 224 can be located in the same plant, and in close proximity to the FCC unit 218 and/or ROSE unit 208, or on-site with the heavy oil or bitumen production 202, 204.

In an embodiment, a coker unit 236 can be employed for improved recovery. A portion of the asphaltene fraction from the ROSE unit 208 can be supplied to coker unit 236. The coker unit 236 can produce a cracked effluent which can include naphthas, distillates and gas oils, and can be combined with the FCC effluent and supplied to the hydrotreater 224 and/or diluent storage 200. The coker unit can be located on-site or in close proximity to the ROSE unit 208 and/or FCC unit 218.

Another advantage to the present invention is an energy cost of near zero once the facilities are installed and operational. Because the asphaltene product can be readily converted to transportable, combustible fuel, the need for imported hydrogen, fuel and/or energy can be eliminated. The current process can thus be self-sufficient with respect to power, hydrogen and steam requirements for the SAGD and hydrotreater processes in the recovery and upgrade of heavy oils and/or bitumens. Production of excess diluent 200 can be sufficiently limited to ensure adequate steam or fuel gas production for self-sufficiency. Similarly, power can be provided to mining equipment, reducing requirements as compared to traditional mining processes. The capital costs associated with the present invention are slightly higher than those associated with other methods for the recovery of bitumens, such as for example, processes employing front end delayed coking or ebullated bed hydrocracking. However, the present invention has a better return on investment, lower complexity and simpler operation, less coke disposal, complete energy self sufficiency, excess diluent production for other diluent consumers, near or far, and can be constructed or be added as an upgrade in a stepwise fashion.

Example. Referring to the process shown in FIG. 3, feed comprising 28,900 m3/d (182,000 BPD (42-gallon barrels per day)) of 10-15 API diluted bitumen and heavy oils is supplied to a diluent recovery unit (DRU) 210. The DRU 210 supplies 24,800 m3/d (156,000 BPD) feed to the ROSE unit 208, where the unit 208 separates the feed into a DAO fraction and an asphaltene fraction. A 3,420 m3/d (21,500 BPD) stream of the asphaltene fraction is supplied to the gasifier 222, and a 3,420 m3/d (21,500 BPD) stream is supplied to the coker unit 236. An 18,000 m3/d (113,000 BPD) resid oil stream is supplied from the ROSE unit 208 to the fluid catalytic cracking (FCC) unit 218. FCC unit 218 removes remaining metals and separates the feed into a light fraction of reduced metal content and a heavy decant oil. A 3,770 m3/d (23,700 BPD) stream of the decant oil is supplied from the FCC unit 218 to the gasifier 222. A 12,700 m3/d (80,000 BPD) stream of a light fraction including primarily of distillates, naphtha and gas oil is fractionated to produce a 9,490 m3/d (59,700 BPD) stream of diluent to storage 200. The remaining distillates and gas oil can be supplied to the hydrotreater 224 with a 2,100 m3/d (13,000 BPD) stream of gas oil collected from the coker 236. Hydrotreater 224 produces 37-41 API synthetic crude at a rate of 20,000 m3/d (100,000 BPD).

While these embodiments have been described with emphasis on the embodiments, it should be understood that within the scope of the appended claims, the embodiments might be practiced other than as specifically described herein.

What is claimed is:

1. A process of naphtha production from heavy oil or bitumen utilizing a fluid catalytic cracking (FCC) unit, comprising:

supplying a feed comprising heavy oil or bitumen or a fraction thereof to a reaction zone of an FCC unit with catalyst at a catalyst-to-oil weight ratio of about 4 to about 10;

operating the reaction zone at a conversion number of about 40 to about 60 to obtain a hydrocarbon effluent comprising naphtha, decant oil, gas oil, and distillate, wherein the naphtha is in excess of 50 percent, based on the weight of the total hydrocarbon effluent from the reaction zone;

gasifying the decant oil at conditions sufficient to burn and partially oxidize at least a portion of the decant oil to produce hydrogen;

hydrotreating at least a portion of the gas oil to produce a hydrotreated product; and blending at least a portion of the distillate with the hydrotreated product to produce a synthetic crude.

2. The process of claim 1 further comprising:

recovering the naphtha from the hydrocarbon effluent;

mixing the recovered naphtha as a diluent with a heavy oil stream to be transported; and transporting the resulting mixture of the recovered naphtha diluent and the heavy oil stream.

3. The process of claim 2 wherein the recovered naphtha diluent has a cut point range from C5 to 290° C. and an API gravity of at least 30.

4. The process of claim 2 further comprising transporting the mixture of heavy oil and diluent to the FCC unit.

5. A process of naphtha production from heavy oil or bitumen utilizing a fluid catalytic cracking (FCC) unit, comprising:

supplying a feed comprising heavy oil or bitumen or a fraction thereof to a reaction zone of an FCC unit with catalyst at a catalyst-to-oil weight ratio of about 4 to about 10;

operating the reaction zone at a conversion number of about 40 to about 60 to obtain a hydrocarbon effluent comprising naphtha, decant oil, gas oil, and distillate, wherein the naphtha is in excess of 50 percent, based on the weight of the total hydrocarbon effluent from the reaction zone;

gasifying the decant oil at conditions sufficient to bum and partially oxidize at least a portion of the decant oil to produce power, steam, hydrogen, or a combination thereof;

hydrotreating at least a portion of the gas oil to produce a hydrotreated product;

blending at least a portion of the distillate with the hydrotreated product to produce synthetic crude; and mixing at least a portion of the naphtha as a diluent with a heavy oil stream to be transported.

6. The process of claim 1 wherein the feed comprises deasphalted oil from a solvent deasphalting process.

7. The process of claim 6 wherein the solvent deasphalting process receives heavy oil or bitumen supplied from a diluent recovery unit (DRU) receiving a mixture of diluent and heavy oil or bitumen from a steam assisted gravity drainage (SAGD) unit, a mining and extraction unit or a combination thereof.

8. The process of claim 6 wherein the solvent deasphalting process produces an asphaltenes-rich stream and further comprising converting the asphaltenes to steam, power, fuel gas, or a combination thereof.

9. The process of claim 1, further comprising producing the heavy oil or bitumen by extraction from mined tar sands.

10. The process of claim 1 further comprising producing the heavy oil or bitumen by injecting a mobilizing fluid through one or more injection wells completed in communication with a reservoir to mobilize the heavy oil or bitumen and producing the mobilized heavy oil or bitumen from at least one production well completed in communication with the reservoir.

11. The process of claim 10 wherein the mobilizing fluid comprises steam generated primarily by combustion of asphaltenes recovered from solvent deasphalting the heavy oil or bitumen.

12. The process of claim 6 wherein the solvent deasphalting process produces an asphaltenes-rich stream and further comprising feeding a portion of the asphaltenes to a delayed coker unit to produce coker liquids and coke.

13. The process of claim 1 wherein the catalyst comprises an MAT catalyst activity ranging from about 35 to about 75.

14. A process of naphtha production from heavy oil or bitumen utilizing a fluid catalytic cracking (FCC) unit, comprising:

supplying a feed comprising at least a fraction of deasphalted oil from a solvent deasphalting process to a reaction zone of an FCC unit with catalyst at a catalyst-to-oil weight ratio of from 4 to 10;

wherein the catalyst has a MAT catalyst activity between 35 and 65;

wherein the solvent deasphalting process receives heavy oil or bitumen supplied from a diluent recovery unit (DRU) receiving a mixture of diluent and heavy oil or bitumen from a steam assisted gravity drainage (SAGD) unit, a mining and extraction unit or a combination thereof;

wherein the solvent deasphalting process produces an asphaltenes-rich stream and further comprising feeding at least a portion of the asphaltenes to a delayed coker unit to produce coker liquids and coke and converting at least a portion of the asphaltenes to steam, power, fuel gas, or a combination thereof;

operating the reaction zone at a conversion number of about 40 to about 60 to obtain a hydrocarbon effluent comprising naphtha, decant oil, gas oil and distillate, wherein the naphtha is in excess of 50 percent, based on the weight of the total hydrocarbon effluent from the reaction zone;

recovering naphtha from the hydrocarbon effluent;

mixing the recovered naphtha as a diluent with a heavy oil stream to be transported;

transporting the mixture of heavy oil and diluent to the FCC unit;

wherein the recovered naphtha diluent has a cut point range from C5 to 290° C. and an API gravity of at least 30;

gasifying the decant oil at conditions sufficient to burn and partially oxidize at least a portion of the decant oil to produce power, steam and hydrogen;

hydrotreating the gas oil with the hydrogen to produce a hydrotreated product; and blending the distillate with the hydrotreated product to produce synthetic crude.

15. A process of naphtha production from heavy oil or bitumen utilizing a fluid catalytic cracking (FCC) unit, comprising:

mixing a feed comprising heavy oil or bitumen or a fraction thereof with a diluent to provide a mixture;

selectively separating the mixture to provide a deasphalted oil fraction and an asphaltene-rich fraction;

introducing at least a portion of the deasphalted oil fraction to a reaction zone of an FCC unit with catalyst at a catalyst-to-oil weight ratio of about 4 to about 10;

operating the reaction zone at a conversion number of about 40 to about 60 to obtain a hydrocarbon effluent comprising naphtha, decant oil, gas oil, and distillate, wherein the naphtha is in excess of 50 percent, based on the weight of the total hydrocarbon effluent from the reaction zone; and gasifying the decant oil at conditions sufficient to bum and partially oxidize at least a portion of the decant oil to produce hydrogen;

hydrotreating at least a portion of the gas oil to produce a hydrotreated product; and blending at least a portion of the distillate with the hydrotreated product to produce a synthetic crude.

16. The process of claim 15, wherein the diluent comprises at least a portion of the naphtha.

17. The process of claim 15, further comprising introducing at least a portion of the asphaltene-rich fraction to a delayed coker to provide coker liquids and coke.

18. The process of claim 15, further comprising gasifying at least a portion of the asphaltene-rich fraction.

19. The process of claim 15, further comprising hydrotreating at least a portion of at least one of the naphtha and the distillate.

20. The process of claim 17, further comprising hydrotreating at least a portion of the coker liquids.

21. The process of claim 1, wherein the decant oil is gasified in the presence of an oxidant.

* * * * *